US007721721B1

(12) United States Patent
Kronengold et al.

(10) Patent No.: US 7,721,721 B1
(45) Date of Patent: May 25, 2010

(54) REVERSIBLE AND ADJUSTABLE MODULE SYSTEM FOR ARCHERY BOW

(75) Inventors: David H. Kronengold, Tucson, AZ (US); Allen C. Rasor, Jr., Marana, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 378 days.

(21) Appl. No.: 11/862,624

(22) Filed: Sep. 27, 2007

Related U.S. Application Data

(60) Provisional application No. 60/827,311, filed on Sep. 28, 2006.

(51) Int. Cl.
*F41B 7/00* (2006.01)

(52) U.S. Cl. ..... 124/25.6; 124/25; 124/25.5; 124/25.7; 124/24.1; 124/23.1; 124/16; 124/86; 124/87; 124/88; 124/89; 124/90; 124/91; 124/92

(58) Field of Classification Search ..... 124/25, 124/25.6, 86–92, 16, 23.1, 25.5, 25.7, 24.1
See application file for complete search history.

(56) References Cited

U.S. PATENT DOCUMENTS 4,562,824 A * 1/1986 Jennings ..... 124/25.6
4,770,154 A * 9/1988 Cook et al. ..... 124/25.6
4,774,927 A * 10/1988 Larson ..... 124/25.6
4,838,236 A * 6/1989 Kudlacek ..... 124/25.6
4,976,250 A * 12/1990 Jeffrey ..... 124/25
4,986,250 A * 1/1991 Darlington ..... 124/25.6
5,505,185 A * 4/1996 Miller ..... 124/25.6
5,535,727 A * 7/1996 Helmuth ..... 124/25.6
5,678,529 A * 10/1997 Larson ..... 124/25.6
5,749,351 A * 5/1998 Allshouse et al. ..... 124/25.6
5,782,229 A * 7/1998 Evans et al. ..... 124/25.6
5,881,705 A * 3/1999 Howell et al. ..... 124/25.6
5,890,480 A * 4/1999 McPherson ..... 124/25.6
5,901,692 A * 5/1999 Allshouse et al. ..... 124/23.1
5,921,227 A * 7/1999 Allshouse et al. ..... 124/25.6
5,934,265 A * 8/1999 Darlington ..... 124/25.6
5,960,778 A * 10/1999 Larson ..... 124/25.6
6,082,346 A * 7/2000 Andrews et al. ..... 124/25.6
6,082,347 A * 7/2000 Darlington ..... 124/25.6
6,237,582 B1 * 5/2001 McPherson ..... 124/25.6
6,247,466 B1 * 6/2001 McPherson ..... 124/25.6
6,250,293 B1 * 6/2001 Andrews ..... 124/25.6
6,267,108 B1 * 7/2001 McPherson et al. ..... 124/25
6,321,736 B1 * 11/2001 McPherson ..... 124/25.6
6,360,735 B1 * 3/2002 Larson et al. ..... 124/25.6
6,382,201 B1 * 5/2002 McPherson et al. ..... 124/89
6,443,139 B1 * 9/2002 McPherson ..... 124/25.6
6,446,619 B1 * 9/2002 McPherson ..... 124/25.6
6,516,790 B1 * 2/2003 Darlington ..... 124/25.6
6,575,153 B2 * 6/2003 Lommasson et al. ..... 124/25.6
6,629,522 B2 * 10/2003 Andrews ..... 124/25.6

(Continued)

*Primary Examiner*—Gene Kim
*Assistant Examiner*—Alexander R Niconovich
(74) *Attorney, Agent, or Firm*—Cahill Glazer PLC

(57) ABSTRACT

An archery bow having a riser, a pair of flexible limbs extending from the riser, with each limb having a rotating member on an axel secured to the end thereof. At least one of the rotating members is a cam having a module secured thereto. The module is positionable with respect to the cam by translational movement and is also positionable on the cam with an opposite face against the cam to selectively provide a desired draw length.

9 Claims, 3 Drawing Sheets

U.S. PATENT DOCUMENTS 6,634,348 B2 * 10/2003 Gallops, Jr. ..... 124/25.6
6,666,202 B1 * 12/2003 Darlington ..... 124/25.6
6,691,692 B1 * 2/2004 Adkins ..... 124/25.6
6,715,479 B1 * 4/2004 Bunk ..... 124/25.6
6,776,148 B1 * 8/2004 Islas ..... 124/25.6
6,871,643 B2 * 3/2005 Cooper et al. ..... 124/25.6
6,966,314 B2 * 11/2005 McPherson ..... 124/89
6,976,484 B1 * 12/2005 Gallops, Jr. ..... 124/25.6
6,990,970 B1 * 1/2006 Darlington ..... 124/25.6
6,994,079 B1 * 2/2006 Darlington ..... 124/25.6
7,047,958 B1 * 5/2006 Colley ..... 124/25.6
7,082,937 B1 * 8/2006 Land ..... 124/25.6
7,188,615 B2 * 3/2007 Chang ..... 124/25.6
RE39,880 E * 10/2007 McPherson ..... 124/25.6
2002/0096159 A1 * 7/2002 McPherson ..... 124/25.6
2002/0144675 A1 * 10/2002 Lommasson et al. ..... 124/25.6
2002/0166550 A1 * 11/2002 Andrews ..... 124/25.6
2004/0074485 A1 * 4/2004 Cooper et al. ..... 124/25.6
2005/0193998 A1 * 9/2005 Cooper et al. ..... 124/25.6
2005/0268892 A1 * 12/2005 Gallops ..... 124/25.6
2006/0000463 A1 * 1/2006 Gallops ..... 124/25.6
2006/0169260 A1 * 8/2006 Chang ..... 124/25.6
2008/0173289 A1 * 7/2008 McPherson ..... 124/25.6
2009/0288650 A1 * 11/2009 Batdorf ..... 124/25.6

* cited by examiner

REVERSIBLE AND ADJUSTABLE MODULE SYSTEM FOR ARCHERY BOW

RELATED APPLICATIONS

The present application claims priority to a provisional application filed Sep. 28, 2006 under Ser. No. 60/827,311 entitled "REVERSIBLE AND ADJUSTABLE MODULE SYSTEM FOR ARCHERY BOW".

FIELD OF THE INVENTION

The present invention pertains to archery bows and more particularly to archery bows having modules attachable to cams for adjusting draw weight and draw length.

BACKGROUND OF THE INVENTION

Archery bows must be customized to fit each specific archer; particularly, each archer has a unique desired draw length and is usually limited to a particular maximum draw weight. Manufacturers and dealers of archery bows thus must produce a variety of bows each having a particular draw weight or draw length so that the archery bow is properly matched to the individual archer. Draw length and draw weight can be changed by archery dealers but such changes are usually limited and require dedicated equipment to accomplish the modifications. Further, such modifications are time consuming and require skill to properly make changes to the draw weight and draw length to fit a particular archer.

SUMMARY OF THE INVENTION

The present invention incorporates the utilization of modules that are attachable to the cams of a compound bow. In the example chosen for illustration, the bow is a dual cam bow; however, the same concept is applicable to a one cam bow. The modules are attachable to the faces or surfaces of a cam and are positionable by translational movement. The modules provide a groove for contacting the cable or cables of the archery bow and include dual profiles along the periphery of the module to permit the module to be reversed or "flipped" to permit the engagement of an opposite surface of the module with the mounting surface of the cam. In the "flipped" position, a different peripheral portion of the cable-engaging groove is presented to the cable during draw. The peripheral profiles of each portion is different with respect to each other such that a draw length provided by one sector on the periphery of the module is different than the draw length provided by the second peripheral sector of the module when the module has been flipped.

DETAILED DESCRIPTION OF THE INVENTION

Figure 1:
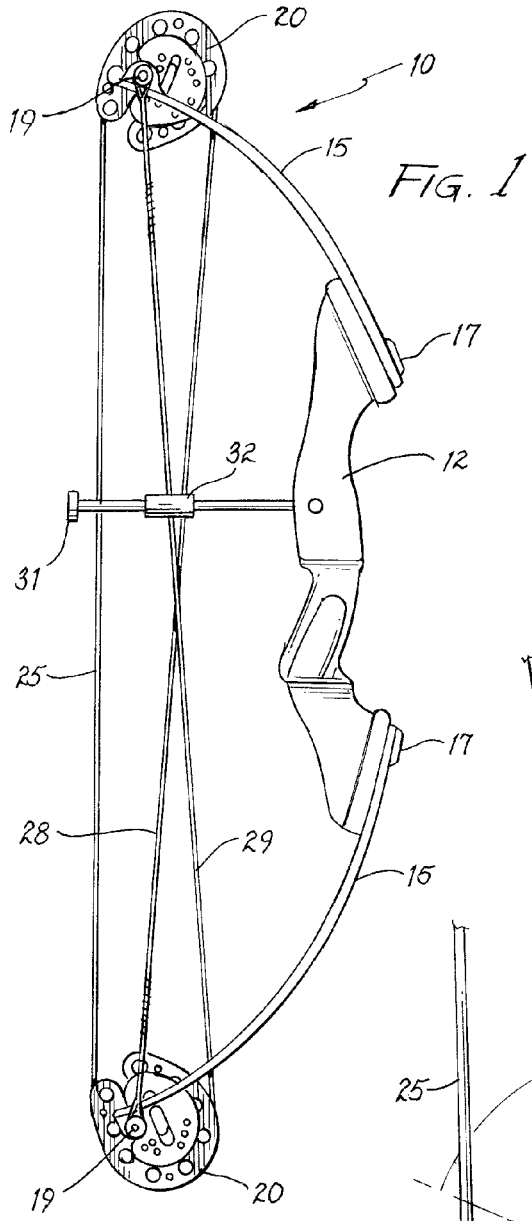
FIG. 1 is a side elevational view of a dual cam bow incorporating the teachings of the present invention.

Referring to FIG. 1, a two cam bow 10 is shown incorporating a riser 12 that includes a grip 14 formed therein. The riser supports a pair of flexible limbs 15 extending therefrom; the limbs are secured to the riser through limb screw bolts 17. The respective ends of the limbs 15 support axels 19 mounted on the respective limbs and support a pair of cams 20 mounted thereon for rotation about the respective axel. A bowstring 25 extends between the upper and lower cams; a cable 28 extends from the upper cam 20 to the lower limb 15. A cable 29 extends from the lower cam 20 to the upper limb 15. A cable guard 31 is mounted on the riser 12 and extends toward the bowstring 25 and supports a cable guard slide 32 which engages the cables 28 and 29 to position the cables out of the plane of motion of the bowstring during draw and bowstring release.

Figure 2A:
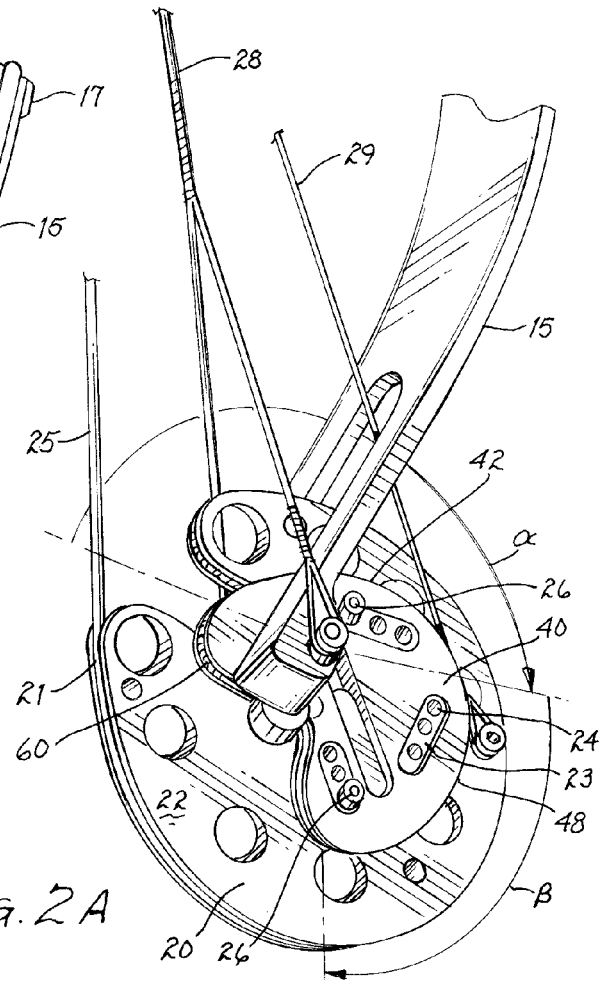
FIG. 2 is an isometric view of the lower cam portion of the bow of FIG. 1.
Figure 3A:
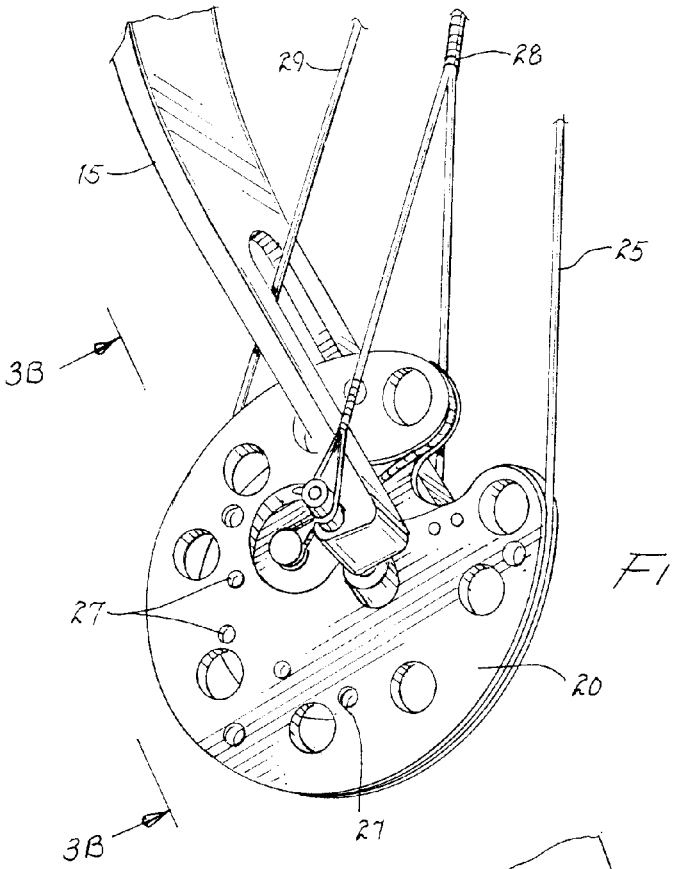
FIG. 3A is an isometric view of an opposite side of the cam shown in FIG. 2.
Figure 3B:
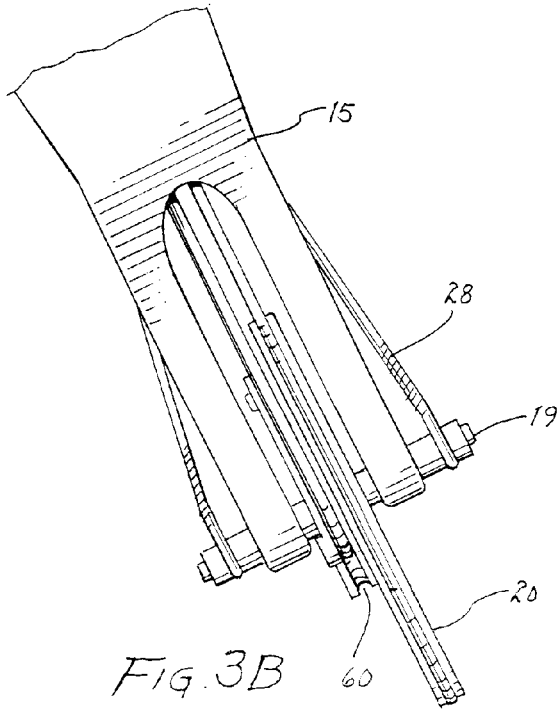
FIG. 3B is an end view of the cam and module shown in FIG. 2.

Referring to FIG. 2, an enlarged isometric view of the lower cam of FIG. 1 is shown. The cam 20 is shown having a cable post 35 to which the cable 29 is secured. The cam 20 includes a bowstring engaging peripheral groove 21 and a flat surface 22 for contacting the module 40. The module may be secured to the surface 22 of the cam 20 through conventional means such as screws 26. The cam is mounted for rotation about axel 19 which is mounted to the flexible limb 15. The cable 28 is shown secured to the limb 15 through the axel 19. A module 40 is shown secured to the cam 20 such as by screw fasteners 26 extending through the module and threadedly engaging threaded holes 27 provided in the cam (FIG. 3A). The module is positioned so that as the bowstring 25 is drawn, the cam 20 rotates imparting rotational movement to the module 40 and causing a peripheral sector 42 to engage the cable 29. From brace height (essentially the position of the bow system as shown in FIG. 1) to a full drawn position, the peripheral sector 42 will continuously contact the cable 29 as the cam 20 and module rotate through an angle alpha as shown in FIG. 2 to establish a predetermined draw length. A second peripheral sector 48 will not contact the cable 29 during the draw and will have no effect on draw length. The draw length is thus determined by the configuration of peripheral sector 42 of the module 40.

In FIG. 2, the module 40 is shown secured to the cam 20 with a first surface in contact with the flat cam surface 22. In this position, the peripheral sector 42 contacts the cable 28 as the cam is rotated and thus determines the draw length. If the module 40 were reversed or "flipped" such that an opposite surface of the module 40 contacts the cam flat surface 22, the second peripheral sector 48 is in position to contact the cable 29 as the cam is rotated, the draw length would then be determined by the second peripheral sector 48.

The module is formed having parallel opposing flat surfaces 50 and 51 (FIGS. 5A, 5B) separated to define a peripheral cable-engaging groove 60 therebetween. As indicated above, the groove 60 has a first peripheral segment 42 and a second peripheral segment 48. The module includes an elongated guide slot 56 that engages a cam guide member 59 that may be formed integrally with and extend upwardly from the cam surface 22. Holes 24 are provided in the module 40 to admit screw fasteners 26 therethrough for engagement with threaded holes 27 in the cam 20. The holes 24 may be arranged in groups and are countersunk 23 to accept metal washers for engaging the screw fasteners as they pass through the module to engage the cam.

Figure 5A:
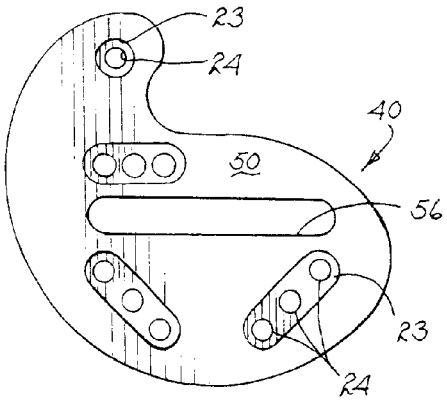
FIGS. 5A and 5B are views of a module constructed in accordance with the teachings of the present invention showing the first and second surfaces for contact with a cam and showing an elongated guide slot.
Figure 5B:
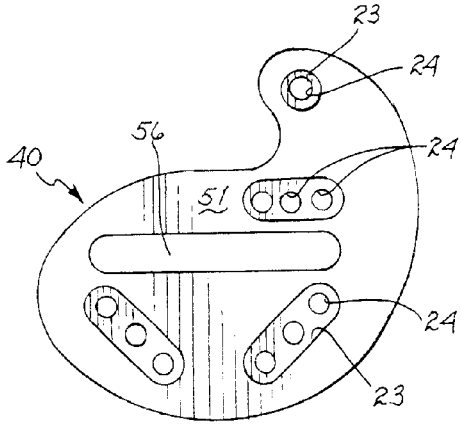

Draw length adjustment using modules such as module 40 is accomplished by changing the amount the cam 20 rotates before reaching a stop position at full draw. Typical cam rotation during draw is in the range of 140° to 220° from brace height to full draw. The reversible module 40 relies upon cam rotation that is a fixed amount less than or greater than 180° and which rotation can be combined into a single module 40. For example, module 40 can be configured to create two distinct draw lengths depending on which flat surface of the module is placed in contact with the corresponding flat surface of the cam. For example FIGS. 5A and 5B illustrate a single module that may be affixed to a corresponding cam with either first surface 50 or second surface 51 in contact with the flat surface of the cam.

Figure 4A:
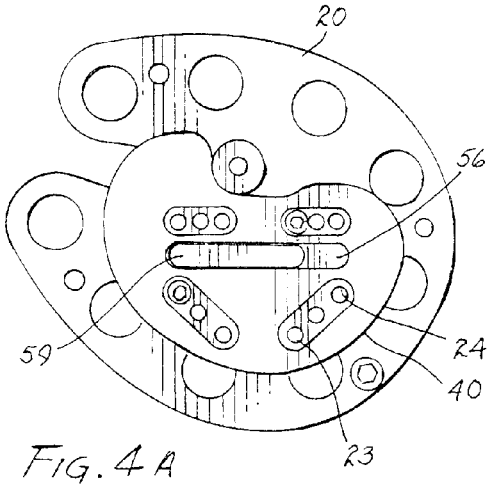
FIGS. 4A, 4B and 4C are successive illustrations of the positioning of the module of the present invention in respective positions on the cam of the bow of FIG. 1 showing the positioning of the module for different draw weights.
Figure 4B:
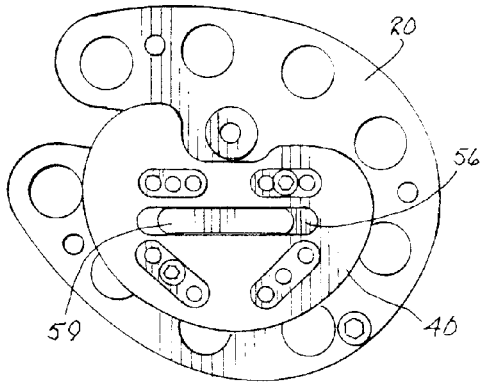
Figure 4C:
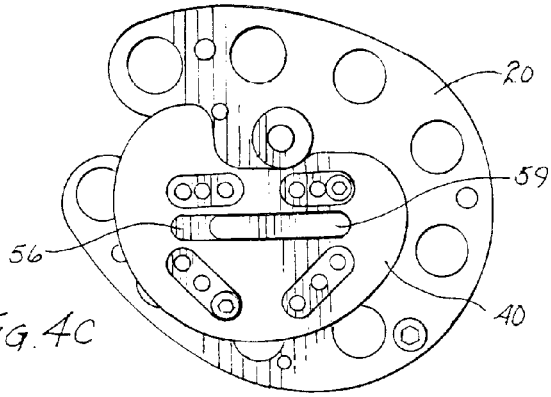

Bow limbs act as energy storage springs and are governed by the basic linear spring equation F=kx (where F=Force, k=spring constant and x=spring deflection). The draw force on the bowstring is directly related to the forces generated by the bow limbs and the mechanical advantage provided by the cam at each rotational position. Bow draw weight changes may be made by adjusting the effective spring constant (k) of the limb to change the draw force (F). Minor adjustments may be made by turning the limb screw bolt 17 in or out, although such adjustments must be limited to prevent accidental dislodgement of the bolt if backed out too far. Adjusting module position acts to increase or decrease both the limb force and the leverage in the draw cycle. At the same time the limb movement is increased or decreased, the mechanical advantage of the cam is inversely decreased or increased. The combination of increased limb movement with decreased leverage changes the effective peak draw weight. Referring to FIGS. 4A through 4C, the module 40 is shown in three separate attachment positions affixed to the cam 20. The cam 20 includes a cam guide member 59 that is integrally formed with the cam, and which extends into an elongated guide slot 56 provided in the module 40.

This interrelationship of the guide slot and guide permits sliding translational movement of the modules over the cam surface. It may be noted that the module does not change its angular position with respect to the cam 20 but merely translates by movement along the slot 56. This translational movement provides insurance against rotational relative movement between the module and the cam and also assists the archer in selecting the appropriate position of the module. Further, the interaction of the guide member 59 and guide slot 56 may permit transmission of torque forces transmitted from and between the cam and module. FIG. 4A illustrates a cam module position that provides a relatively light draw weight. Similarly, FIG. 4C illustrates the positioning of the module to provide a heavy draw weight, while FIG. 4B illustrates the positioning of the module for a medium draw weight. As described above in connection with the positioning of a specific module on the cam, the module may be reversed or "flipped" to change the draw length independently of the draw weight.

Thus it may be seen that a pair of modules, one each for the upper and lower cams of a dual cam bow, may be used as in the example given above. That is, each module may be attached to a corresponding cam to provide a selected draw length; that same cam may be positioned on the corresponding cam by sliding/translational movement to a desired draw weight position. Thus, the individual modules permits the selection of two draw lengths combined with a selection of three draw weights for each selected draw length. Thus, an archery dealer having an inventory of selected bows may provide a prospective purchaser with a bow of the characteristics chosen by the purchaser together with a set of attachable modules to permit the purchaser to customize the bow. The combination of available draw lengths and draw weights permits the purchaser to select the appropriate weight and draw length while permitting the dealer to stock fewer bows since each bow can be customized over a broad range of draw weights and draw lengths.

As an example of the implementation of the present invention, the following chart provides a selection of module sizes together with the available draw lengths and weight settings available with the respective modules. Assuming for example, the archer desires a 28" draw length. From the chart below it may be seen that he would select module C". If the archer desired an approximate 65 pound peak draw weight, the archer would select the medium or "M" translational position of the module on the cam. With the module thus in the proper position on the cam, the module is then secured to the cam with two screw fasteners that are aligned with corresponding threaded holes in the cam. Minor weight adjustments may subsequently be made by turning the limb screw bolts to "fine tune" the desired weight.

| Module | Weight | Approx. Draw | Approx Weight Range | |
|---|---|---|---|---|
| No. | Setting | Length | 60# Peak | 70# Peak |
| A | H | 31.50 | 40-60 | 50-70 |
| A | M | 31.25 | 35-55 | 45-65 |
| A | L | 31.00 | 30-50 | 40-60 |
| B | H | 30.50 | 40-60 | 50-70 |
| B | M | 30.25 | 35-55 | 45-65 |
| B | L | 30.00 | 30-50 | 40-60 |
| C | H | 29.50 | 40-60 | 50-70 |
| C | M | 29.25 | 35-55 | 45-65 |
| C | L | 29.00 | 30-50 | 40-60 |
| C' | H | 28.50 | 40-60 | 50-70 |
| C' | M | 28.25 | 35-55 | 45-65 |
| C' | L | 28.00 | 30-50 | 40-60 |
| B' | H | 27.50 | 40-60 | 50-70 |
| B' | M | 27.25 | 35-55 | 45-65 |
| B' | L | 27.00 | 30-50 | 40-60 |
| A' | H | 26.50 | 40-60 | 50-70 |
| A' | M | 26.25 | 35-55 | 45-65 |
| A' | L | 26.00 | 30-50 | 40-60 |

Thus, it may be seen that the dealer may stock a single bow and provide that bow to an archer with a total of eighteen selected values for draw weight and length.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed:

1. An archery bow having a riser, a pair of flexible limbs extending from the riser, each of said limbs having a rotating member mounted on an axel secured to the respective limb, at least one of said rotating members comprising a cam, a bowstring extending between said rotating members, and a cable extending from said cam to an opposite limb;

a module having first and second parallel opposing flat surfaces separated to define a peripheral cable-engaging groove therebetween, said groove having a first peripheral segment and a second peripheral segment;

said cam having a bowstring engaging peripheral groove and having a flat surface for contacting one of the parallel opposing flat surfaces of the module; and said archery bow having a draw length when said first parallel opposing flat surface of the module is in contact with the flat surface of the cam and a different draw length when the second parallel opposing flat surface of the module is in contact with the flat surface of the cam.

2. The archery bow of claim 1 including a plurality of screw fasteners securing the module to the cam in a selected translational position and with a selected opposing flat surface of the module in contact with the flat surface of the cam.

3. An archery bow having a riser, a pair of flexible limb extending from the riser, each of said limbs having a rotating member mounted on an axel secured to the respective limb, at least one of said rotating members comprising a cam, a bowstring extending between said rotating members, and a cable-extending from said cam to an opposite limb;

a module having first and second parallel opposing flat surfaces separated to define a peripheral cable-engaging groove therebetween, said groove having a first peripheral segment and a second peripheral segment;

said module including an elongated guide slot for engaging a cam guide member, said guide member and guide slot, when engaged, permitting only translational movement between the module and cam;

said cam having a bowstring engaging peripheral groove and having a flat surface for contacting one of the parallel opposing flat surfaces of the module, said cam including a guide member extending from the cam flat surface and extending into said guide slot; and said archery bow having a draw length when said first parallel opposing flat surface of the module is in contact with the flat surface of the cam and a different draw length when the second parallel opposing flat surface of the module is in contact with the flat surface of the cam.

4. The archery bow of claim 3 including a plurality of screw fasteners securing the module to the cam in a selected translational position and with a selected opposing flat surface of the module in contact with the flat surface of the cam.

5. An archery bow having a riser, a pair of flexible limbs extending from the riser, each of said limbs having a rotating member mounted on an axel secured to the respective limb, at least one of said rotating members comprising a cam, a bowstring extending between said rotating members, and a cable extending from said cam to an opposite limb;

a module for mounting on said cam, said module including an elongated guide slot for engaging a cam guide member, said guide member and said guide slot, when engaged, permitting only translational movement between the module and cam; and means for securing said module to the cam in a selected translational position.

6. In an archery bow system having a riser, a pair of flexible limbs extending from the riser, each of said limbs having a rotating member mounted on an axel secured to the respective limb, at least one of said rotating members comprising a cam, a bowstring extending between said rotating members, and a cable extending from said cam to an opposite limb, the improvement comprising;

a module attachable to said cam for adjusting draw weight comprising:

(a) first and second parallel opposing flat surfaces separated to define a peripheral cable-engaging groove therebetween;

(b) an elongated guide slot for engaging a cam guide member, said guide member and guide slot, when engaged permitting only translational movement between the module and cam;

means for securing said module to the cam in a selected translational position.

7. The archery bow of claim 6 including a plurality of screw fasteners securing the module to the cam in a selected translational position and with a selected opposing flat surface of the module in contact with the flat surface of the cam.

8. An archery bow having a riser, a pair of flexible limbs extending from the riser, each of said limbs having a cam mounted on an axel secured to the limb, a bowstring extending between said cams, and a cable extending from each of said cams respectively to an opposite limb;

a pair of modules each having a first and second parallel opposing flat surfaces separated to define a peripheral cable engaging groove therebetween, said groove having a first peripheral segment and a second peripheral segment;

each of said cams having a bowstring engaging peripheral groove and having flat surfaces for contacting one of the parallel opposing flat surfaces of one of said modules;

said archery bow having a draw length when said first parallel opposing flat surfaces of the respective modules is in contact with the flat surface of a respective cam and a different draw length when a second parallel opposing flat surface of the respective module is in contact with the flat surface of a cam respectively.

9. The archery bow of claim 8 including a plurality of screw fasteners securing the modules to the respective cams in selected translational positions and with a selected opposing flat surface of the respective module in contact with the flat surface of a cam.

* * * * *